United States Patent [19]

Vermeulen-Amelot et al.

[11] 4,040,221

[45] Aug. 9, 1977

[54] LOAD-BEARING CONCRETE MEMBERS PROVIDED WITH MOISTURE AND DAMP PROOF

[76] Inventors: Françoise Vermeulen-Amelot, 69, Avenue du Manoir; Thierry F. Vermeulen, 17, avenue du Belier, both of Waterloo, Belgium

[21] Appl. No.: 665,158

[22] Filed: Mar. 8, 1976

[30] Foreign Application Priority Data

Mar. 7, 1975 Germany ..... 2510061

[51] Int. Cl.[2] ..... E04B 1/64; E04C 2/32

[52] U.S. Cl. ..... 52/265; 52/408; 52/612; 264/253; 264/DIG. 57

[58] Field of Search ..... 52/404, 408, 410, 612, 52/265, 220; 264/DIG. 57, 71, 253, 256, 257

[56] References Cited

U.S. PATENT DOCUMENTS

| | | | |
|---|---|---|---|
| 124,344 | 3/1872 | Dodge | 52/407 |
| 1,096,773 | 5/1914 | Vernon | 52/407 |
| 1,417,553 | 5/1922 | Muench | 52/405 |
| 1,510,224 | 9/1924 | Hicks | 52/405 |
| 1,700,156 | 1/1929 | Copeman | 264/71 |
| 1,815,921 | 7/1931 | Lapof | 52/405 |
| 2,370,638 | 3/1945 | Crowe | 264/DIG. 57 |

FOREIGN PATENT DOCUMENTS

| | | | |
|---|---|---|---|
| 481,597 | 3/1952 | Canada | 52/612 |
| 499,098 | 6/1948 | Canada | 52/410 |
| 606,368 | 8/1948 | United Kingdom | 52/408 |

*Primary Examiner*—James L. Ridgill, Jr.
*Attorney, Agent, or Firm*—Owen, Wickersham & Erickson

[57] ABSTRACT

The disclosure relates to load-bearing reinforced concrete members, such as beams, slabs, shells, panels, walls, or like members provided with a moisture and damp proof insertion embedded in the concrete substantially within the entire expanse of the member.

12 Claims, 9 Drawing Figures

LOAD-BEARING CONCRETE MEMBERS PROVIDED WITH MOISTURE AND DAMP PROOF

The invention relates to load-bearing reinforced concrete members, such as beams, slabs, shells, panels, walls, or like members provided with a moisture and damp proof insertion embedded in the concrete substantially within the entire expanse of the member.

Every attempt that has been made in the past effectively and permanently to seal concrete, which as such is pervious to moisture, by embedding a moisture and damp proof insulating insertion in the concrete has in practice been a failure because the presence of such an insulating insertion decisively impairs the strength and load-bearing capacity of the concrete member. A load-bearing concrete member always contains zones stressed for compression and zones stressed for tension separated by a neutral zone or layer. The presence of an insulating insertion breaks the continuity of these zones and causes the monolithic character of the concrete member to be destroyed. The member may in fact be considered as having been split, with respect to its load-bearing capacity and strength, into two completely separate superimposed load-bearing concrete elements. Particularly when the insulating insertion is located in the region of the neutral zone, but also when it is placed within either the compression or tension zone, the concrete at the interfaces with the insertion tends to slide on the insertion because the forces acting on the two sides of the insertion act in opposite directions and may be of different magnitudes.

It is an object of the present invention to provide moisture and damp proof load-bearing concrete members, particularly members having thin cross sections, with an insulating insertion without thereby significantly disturbing the monolithic nature of the member as regards its load-bearing strength.

The basic thought which underlies the invention consists in that a synthetic plastics foil which extends to and fro substantially through the entire statically effective thickness of the concrete cross section divides the concrete not in a direction normal to the direction of the load but rather in the direction in which the loads acts. The portions of the plastics foil which extend from one face to the other face of the concrete member divide up the concrete member in such a way that in a direction normal to the load-prismatic adjacent self-contained load bearing elements are formed which extend in their longitudinal direction from one end to the other of the span of the member, and which each individually contains its own compression, tension and neutral zone. In other words, the discontinuities cut through the concrete member by the plastics foil that forms the insulating insertion are so located that the effective static load-bearing capacity is not affected. In this respect the monolithic character of the member is preserved.

The present proposal therefore permits a moisture and damp proof concrete member having a thin cross section to be produced. Furthermore, the employment of a synthetic plastics foil also considerably reduces the risk of shearing and mutual sliding dislocation between the regions separated by the foil because it allows the grains structure of the concrete to impress itself into the foil from both sides. It has been found that a particularly suitable plastics foil is one having a surface that adheres well to concrete. Decisive for the preservation of the monolithic character of the concrete member resulting from the proposed disposition and arrangement of the plastics insertion is, however, the act that —excepting the regions where the foil curves back near the surfaces of the concrete member —the compressive and tensile forces in the concrete on both sides of the foil are codirectional and equal in magnitude.

In a preferred embodiment of the invention the member includes two sets of parallel reinforcement bars extending parallel to the span of the member, and each lying in one of two planes one near each face of the member, and in which the foil is partially wrapped to and fro about bars alternatively of the two sets. The reinforcement may be pretensioned or slack. The proposed disposition of the reinforcement ensures that the adjacent roughly prismatic load-bearing elements which are divided off by the foil and extend along the length of the span are all reinforced in conventional manner — each element separately for itself without interference by the plastics foil. The number, disposition and spacing of the reinforcement bars may be adapted to the contemplated application of the concrete member.

In a preferred embodiment of the invention the plastics foil may extend substantially straight from a bar of one set to a bar of the other set, so that the roughly prismatic load-bearing elements extending from one end to the other of the span of the concrete member are triangular in cross section. The concrete member may then be considered as being composed of a plurality of closely adjacent prismatic load-bearing beams, each of the same span as the concrete member as a whole.

A method of producing a concrete member according to the invention may include locating the plastics foil by means of the reinforcement in a position in which it extends to and fro between the side walls of a vertical shuttering and then pouring concrete from above into the spaces on each side of the foil and compacting the concrete, for example by vibration.

A useful way of producing the concrete member comprises erecting in a shuttering the first set of reinforcement bars which are to be positioned on one side of the plastics foil, placing the plastics foil against these first reinforcement bars, and then introducing a second set of reinforcement bars which are to be positioned on the other side of the plastics foil, pushing these forward into the spaces between the bars of the first set and thereby deflecting the foil into a position in which this extends from one side to the other of the cross section. The plastics foil is thus conveniently positioned as desired inside the concrete member that is about to be cast. The plastics foil may be slightly tensioned between the members of the reinforcement.

Moreover, with advantage each set of bars includes bars near to each face of the member and the bars of each set which are spaced away from the plastics foil are interconnected by cross ties, and the relative interengaging motion of the first and second sets of reinforcement bars for deflecting the interposed plastics foil is discontinued at a point when the reinforcement bars which bear and deflect the foil remain at a distance at least equal to the thickness of the plastics foil from the cross ties connecting the other set of reinforcement bars. The proposed disposition of the plastics foil will not then interfere with the provision of cross ties at least near the surfaces of the concrete member for the purpose of connecting the sets of reinforcement bars on either side of the foil in a reinforcing mesh.

An embodiment of a concrete member according to the invention and the manner in which it can be produced will now be more particularly described, purely by way of example, with reference to the accompanying drawings in which.

Figures 1, 2:
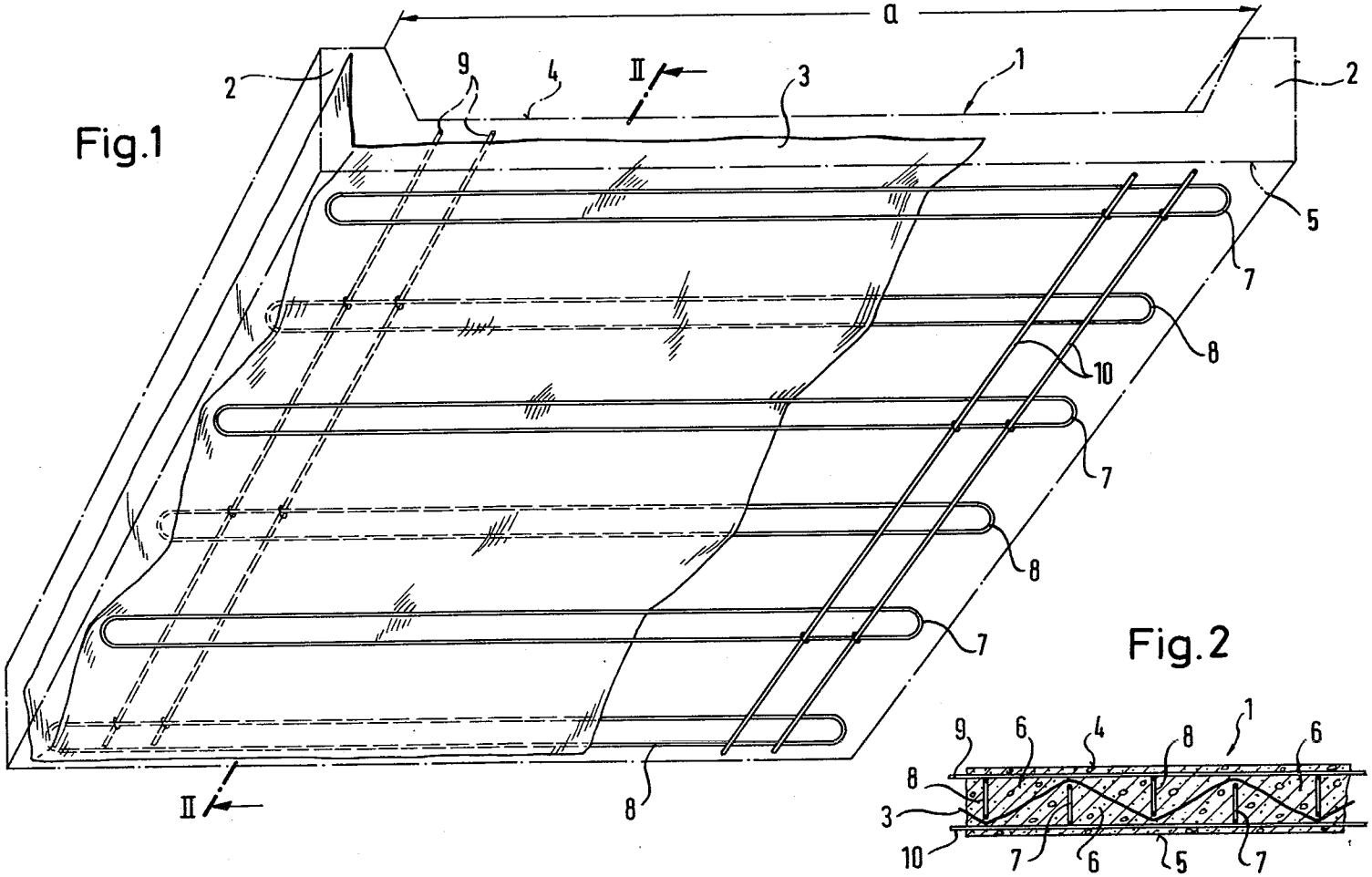
FIG. 1 is a diagrammatic perspective view from below of a concrete slab drawn as if it were "transparent;"
FIG. 2 is a section taken on the line II—II in FIG. 1.

The concrete slab illustratively shown in FIGS. 1 and 2 has a thin cross section (possibly less than 10 cm) and is formed along its ends extending across transversely to the span *a* of the member with flange ribs 2 adapted to rest on bearing abutments or to be anchored in a supporting structure. Embedded in the concrete slab 1 is a synthetic plastics foil 3 which extends across the entire expanse of the slab 1 and serves as an insulating layer to prevent the penetration of moisture. As will be understood, more particularly by referring to FIG. 2, this synthetic plastics foil 3 runs to and fro from one face 4 to the other face 5 of the concrete slab and thus extends through the entire thickness of the statically effective cross section of the concrete slab. The layer thus defines a plurality of self-contained zones which may be described as independent roughly prismatic load-bearing elements extending from one end of the span *a* to the other. In the illustrated embodiment the configuration of the plastics foil 3 divides off load-bearing elements of substantially triangular cross section.

Embedded in the concrete slab 1 is a first set of reinforcement bars 7 and a second set of bars 8, all of which extend in the direction of the span *a* of the part. The first set of reinforcement bars 7 is located on one side of the plastics foil 3, whereas the second set of bars 8 is located on the other side of the foil 3. It will therefore be apparent that alternate neighbouring load-bearing elements 6 contain reinforcement bars 7 of the first and reinforcement bars 8 of the second set. However, the member and disposition of the reinforcement bars in each load-bearing element 6 may be determined according to the intended use of the slab 1.

In the arrangement shown each set of bars includes pairs of bars one near to each face of the slab, and the plastics foil is partially wrapped round one bar of each pair while the other bar is spaced away from the foil. The reinforcement bars of each set 7 or 8 which are spaced from the foil are connected together by cross ties 9 and 10. The reinforcement bars of sets 7 and 8 which are directly adjacent the plastics foil 3 are spaced away from the cross ties 10 and 9 of the other set to allow room between these bars and the cross ties 10 and 9 for the plastics foil 3.

Inside the flange ribs 2 the plastics foil 3 is roughly perpendicularly up-ended. It is thus easily possible to create a moisture-proof joint between the abutting flange ribs 2 of slabs joined end to end by providing the two adjacent flange ribs 2 with a moisture-proof capping. The plastics foil 3 may be arranged to project from the longitudinal edges of the slab 1 which extend in the direction of the span *a*, so that it can be fused or adhesively bonded to the projecting foil of a laterally adjacent concrete slab. The plastics foil does not offer significant resistance to being bent upwards substantially at right angles into the flange ribs 2, notwithstanding its undulating configuration inside the thickness of the concrete slab 1. The plastics foil 3 is capable of yielding elastically to a sufficient extent to avoid the creation of crinkles and bulges. In fact, minor irregularities favour the overall effect of the foil 3. It has been established that a good type of plastics foil is one having a surface that readily bonds to the concrete. Moreover, it will be appreciated that the load-bearing elements 6 which are divided off by the foil 3 and extend in the direction of the intended span *a* of the slab need not have precise prismatic cross sections, i.e. they need not have exactly parallel longitudinal edges. Also, the prismatic load-bearing elements may taper in one direction, depending upon how the plastics foil can be arranged. The important feature of the arrangement is that the plastics foil should extend to and fro from one side to the other substantially through the entire thickness of the statically effective cross section and thus define closely adjacent load-bearing elements. The statically effective cross section of a reinforced slab is substantially determined by the position of the outermost reinforcement bars.

Figure 3:
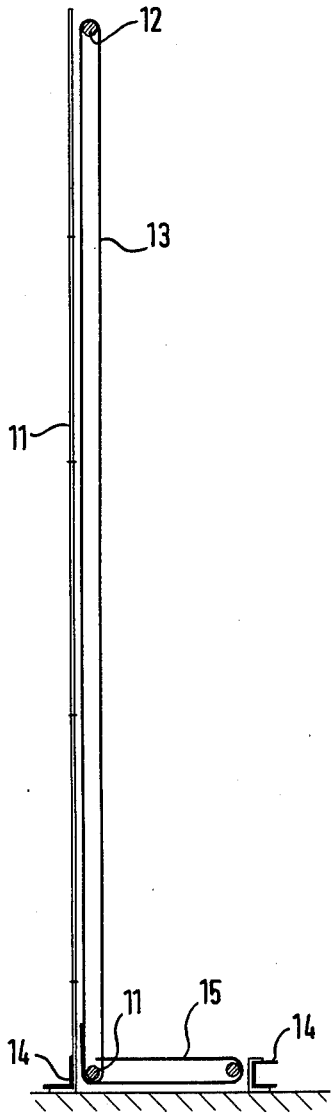
FIGS. 3 to 8 are sectional views of consecutive stages in the production of a concrete slab according to the invention.
Figure 4:
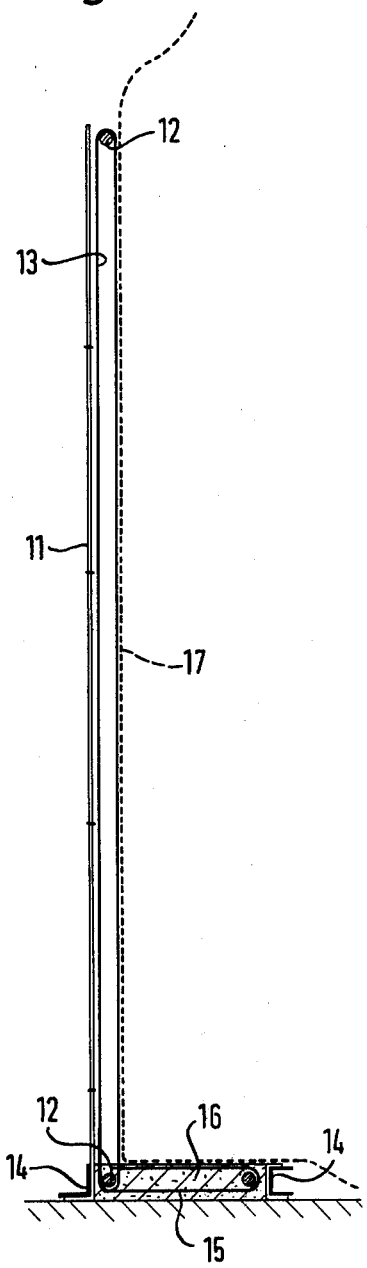
Figure 5:
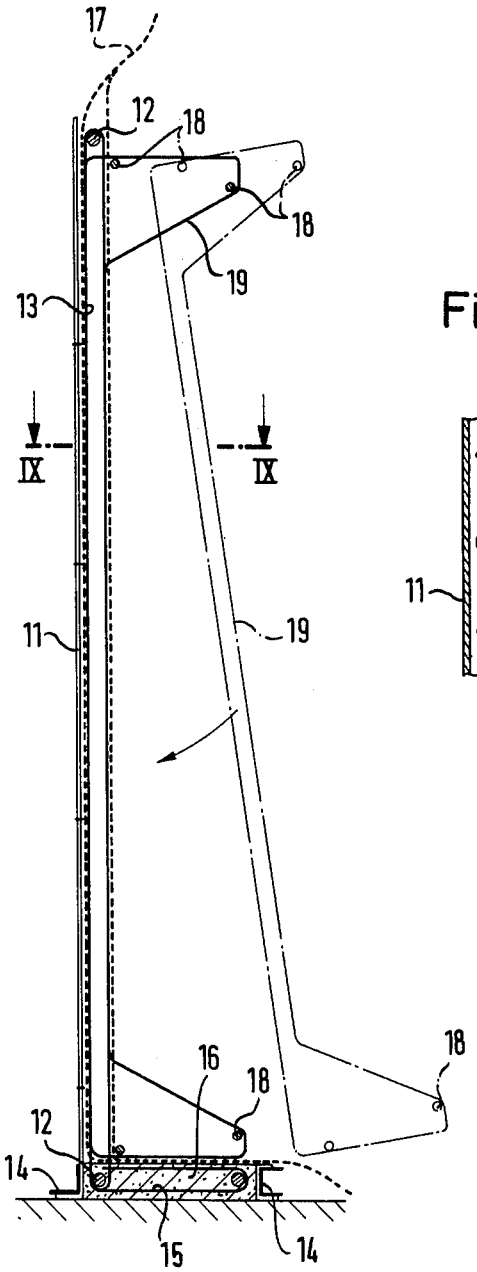
Figure 9:
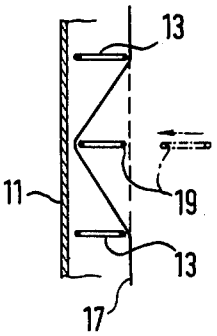
FIG. 9 is a section taken on the line IX—IX in FIG. 5.

The method proposed of making for instance a concrete slab formed with flange ribs will now be described with reference to FIGS. 3 to 9 of the drawings. As shown in FIG. 3 the reinforcement bars 13 of a first set connected by cross ties 12 are first erected parallel to one vertical side 11 of a shuttering. The reinforcement 15 for the flange rib at the bottom of the concrete part is placed in suitable disposition between parts 14 of the shuttering. When the concrete for at least the bottom part of the flange rib in FIG. 4 has been poured, a plastics foil 17 is placed on the concrete 16 of the flange rib and up against the reinforcement bars 13. From the right hand side in FIG. 5 the second set of reinforcement bars 19 spaced by cross ties 18 and intended to be located intermediately between the reinforcement bars 13, as shown in FIG. 9, is now pushed up against the plastics foil 17. When the second set of bars 19 is in its final position, as will be understood from FIGS. 5 and 9, the foil 17 will have been deflected into the desired zig-zag configuration in which it will be retained by the reinforcement bars 13 and 19 in cooperation.

Figure 6:
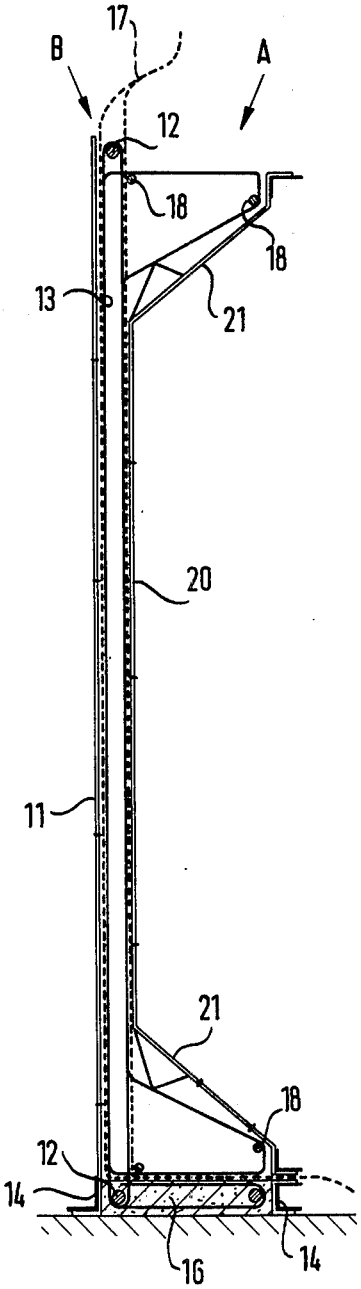
Figure 7:
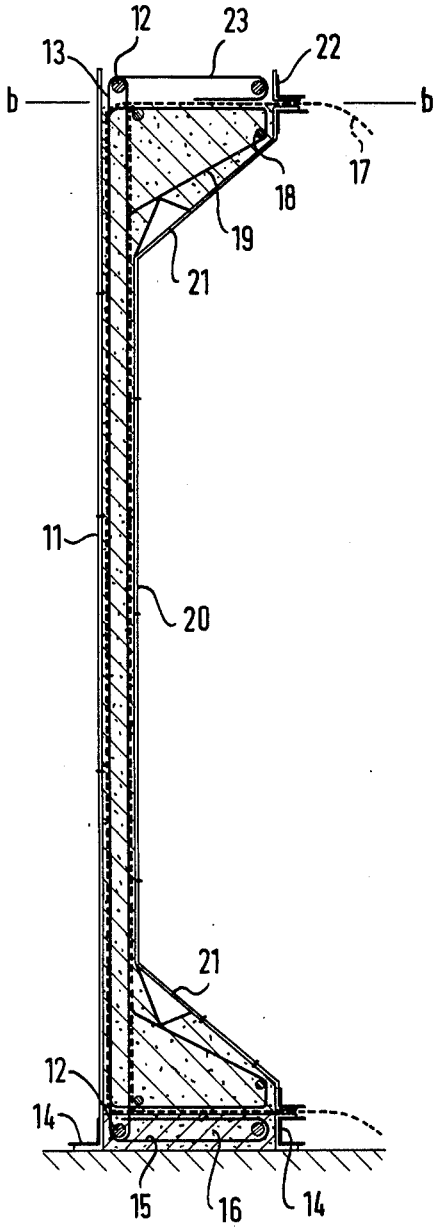
Figure 8:
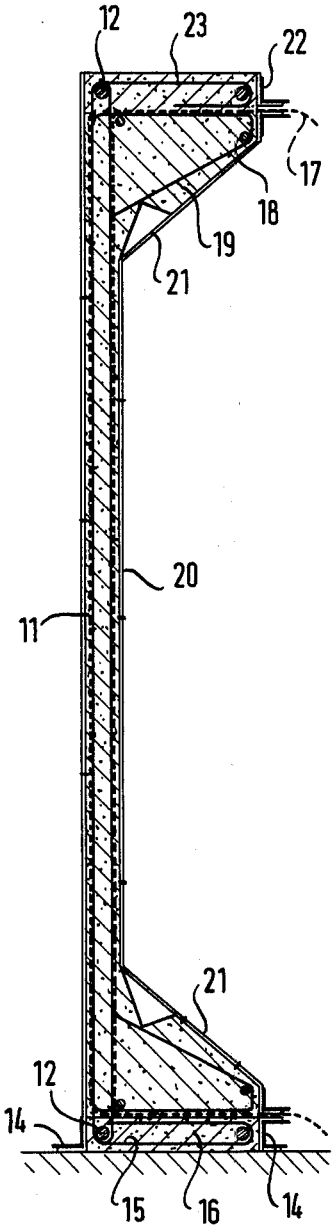

In the illustrated embodiment the top and bottom ends of the reinforcement bars 19 are so shaped that they simultaneously provide the reinforcement for the flange ribs. When the second set of reinforcement bars 19 has been positioned as described, the other vertical side 20 of the shuttering is erected, as indicated in FIG. 6. The top and bottom of this side of the shuttering have offset constructions 21 for forming the desired flange ribs. The concrete can now be poured from above into the spaces on each side of the foil 17, as indicated by arrows A and B, and the concrete compacted, as is well understood, by vibration or in some other way until the foil 17 is completely and evenly embedded to nearly the top of the shuttering. When the concrete has reached the level indicated by the line *b—b* in FIG. 7, the foil is folded over to the right and a covering shutter member 22 for the upper part of the upper flange rib is fitted, a suitable reinforcement inserted and covered with a final layer of concrete as shown in FIG. 8.

What we claim is:

1. A load-bearing concrete member, such as a beam, slab, shell, panel, wall, or like member, comprising a single unitary piece of concrete having a pair of faces, a pair of lateral edge walls, and a pair of end walls, reinforcing rods of steel embedded in said single piece of concrete, and a moisture and damp proof, insulating, synthetic plastic foil sheet embedded in said single unitary piece of concrete and extending substantially over the entire area of said piece defined by said walls, said foiled sheet being disposed in a corrugated pattern so as to extend to and fro from near one said face to near the other said face through substantially the entire thickness of the statically effective cross section of the concrete piece and so as to divide the concrete piece into roughly prismatic load-bearing elements each extending from one said end wall to the other of the concrete piece.

2. A member as claimed in claim 1 which includes as said reinforcing rods two sets of parallel reinforcement bars extending parallel to said lateral edge walls, each said bar having a portion lying in one of two planes, the bars of a first said set having a portion lying in a first plane near and parallel to one said face and the bars of the second set having a portion lying in a second plane near and parallel to the other said face, said foil sheet being so corrugated as to approach said first plane and pass between said first plane and a bar of said second set and then to approach said second plane and pass between said second plane and a bar of said first set, and so on in alternation.

3. A member as claimed in Claim 2, in which the plastic foil sheet extends substantially straight from a locus between said first plane and a bar of said second set to a locus between said second plane and a bar of said first set, and so on in said alternation, so that the roughly prismatic load-bearing elements extending from one end wall to the other are triangular in cross section.

4. A member as claimed in claim 1, in which said plastic foil sheet projects beyond each said lateral edge wall, so that it can be connected by fusion or by an adhesive bond to the projecting edges of the foil sheets of neighbouring concrete members on one or each side.

5. A member as claimed in claim 1 in which said piece is a concrete load-bearing slab formed with flange ribs at each said end wall, which extend transverse to said lateral edge walls and which are intended to be supported by abutments or to be anchored in supporting structures, said plastic foil sheet being upturned into the flange ribs roughly perpendicular to said faces of the slab.

6. A load-bearing concrete member, comprising a one-piece, single-poured, concrete unit having first and second parallel faces, a pair of parallel side edges, and a pair of parallel end edges, a series of steel reinforcing members, each lying in a vertical plane perpendicular to said faces, said vertical planes being parallel to each other, said series comprising two sets of reinforcing members, a first set having a portion lying in a first horizontal plane close to and parallel to said first face and a second set having a portion lying in a second horizontal plane close to and parallel to said second face, said first set being spaced away from said second plane and said second set being spaced away from said first plane, and a moisture-and-damp-proof-insulating sheet of a synthetic plastic embedded in said concrete and so shaped therein as to extend to and fro in a series of planes inclined to said faces, from a locus between said first plane and a bar of said second set to a locus between said second plane and an adjacent bar of said first set and so on from one said side edge to the other of said unit, so as to divide said unit into roughly prismatic load-bearing elements each extending from one said end edge to the other.

7. A member as claimed in claim 6 which includes a plurality of reinforcing ties, at least one tie joining together the reinforcing members of said first set and lying or in close to said first plane, and at least one tie joining together the reinforcing members of said second set and lying in or close to said second plane.

8. A member as claimed in claim 6 having flanged ribs at its ends and defining said end walls, said ribs extending transversely to said lateral edge walls, said sheet being upturned into each flange rib in a direction roughly perpendicular to the planes of said faces.

9. A method of making a unitary reinforced concrete member, comprising the steps of placing a generally parallel vertical series of reinforcement rods in a series of vertical planes between the side walls of a vertical shuttering, placing a sheet of moisture-and-damp-proof plastic to extend from one side of a reinforcement rod to the opposite side of the next reinforcement rod and then back to said one side of the next reinforcement rod, and so on, so that it extends to and fro, pouring the concrete from above into the spaces on each side of said sheet, compacting the poured concrete, and setting said concrete.

10. A method as claimed in claim 9, in which the step of placing the reinforcement rods includes placing a first set of reinforcement bars, comprising every other bar, then placing the plastic sheet loosely in a plane against and on one side of said first set of reinforcement bars, and then placing a second set of reinforcement bars on the other side of the plastic sheet, and then pushing forward said second set of bars into the intermediate spaces between the bars of the first set, thereby deflecting said sheet from the plane into its to-and-fro shape.

11. A method as claimed in claim 10, including maintaining the plastic sheet under slight tension by means of the two sets of reinforcement bars.

12. A method as claimed in claim 10, including interconnecting the bars of each set before placing them in position, by cross ties that lie close to said side walls, applying, when placing said second set, a relative interengaging motion of the first and second sets of reinforcement bars for deflecting the interposed plastic sheet, and discontinuing said interengaging motion at a point where the reinforcement bars which bear and deflect the sheet remain at a distance at least equal to the thickness of the plastic foil from the cross ties connecting the other set of reinforcement bars.

* * * * *

UNITED STATES PATENT AND TRADEMARK OFFICE

CERTIFICATE OF CORRECTION

PATENT NO. : 4,040,221

DATED : August 9, 1977

INVENTOR(S) : Francoise Vermeulen-Amelot & Thierry F. Vermeulen

It is certified that error appears in the above-identified patent and that said Letters Patent are hereby corrected as shown below:

Item [54], Title, left-hand column of first page, and Column 1, line 5, after "PROOF" insert --INSERTIONS--. The full title should read --LOAD-BEARING CONCRETE MEMBERS PROVIDED WITH MOISTURE AND DAMP PROOF INSERTIONS--.

Column 1, line 45, "loads acts" should read --load acts--.

Column 2, line 3, "the act that" should read --the fact that--.

Column 6, line 16, which is line 4 of claim 7, "lying or in close to" should read --lying in or close to--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*